US006185784B1

(12) United States Patent
Gämperle

(10) Patent No.: US 6,185,784 B1
(45) Date of Patent: Feb. 13, 2001

(54) RUNNING MECHANISM ASSEMBLY FOR A SLIDING DOOR

(75) Inventor: Walter Gämperle, Oberuzwil (CH)

(73) Assignee: EKU AG, Sirnach (CH)

( * ) Notice: Under 35 U.S.C. 154(b), the term of this patent shall be extended for 0 days.

(21) Appl. No.: 09/378,589

(22) Filed: Aug. 20, 1999

(30) Foreign Application Priority Data

Sep. 3, 1998 (CH) ..... 1800/98

(51) Int. Cl.[7] ..... E05D 15/12
(52) U.S. Cl. ..... 16/99; 16/105
(58) Field of Search ..... 16/87.2, 99, 97, 16/105

(56) References Cited

U.S. PATENT DOCUMENTS 2,999,267 * 9/1961 Sterling et al. ..... 16/105
3,041,657 7/1962 McNinch .
3,142,859 * 8/1964 Suska ..... 16/105
4,106,876 8/1978 Tregoning .
4,134,178 * 1/1979 Stevens ..... 16/105 X
5,404,675 * 4/1995 Schmidhauser ..... 49/409

FOREIGN PATENT DOCUMENTS 0 814 226 12/1997 (EP) .

* cited by examiner

*Primary Examiner*—Robert J. Sandy
(74) *Attorney, Agent, or Firm*—Akin, Gump, Strauss, Hauer & Feld, L.L.P.

(57) ABSTRACT

A running mechanism assembly for a sliding door (9) includes a roller carrier (13) which is vertically (height) adjustable by an eccentric disk (15) relative to the sliding door (9). The adjustment takes place with a tool, for example a socket head cap screw wrench, by rotating the eccentric disk (15). After adjustment, the adjusted position can be fixed with a locking screw (19) mounted in a thread (20) on the eccentric disk (15).

9 Claims, 1 Drawing Sheet

FIG. 1
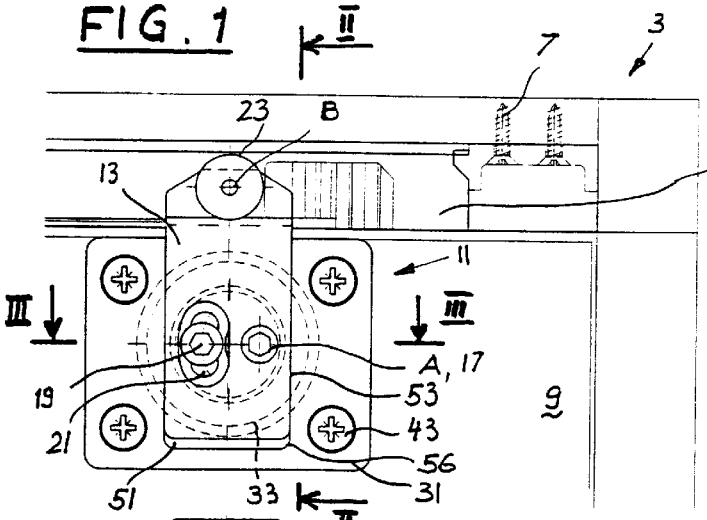
FIG. 2
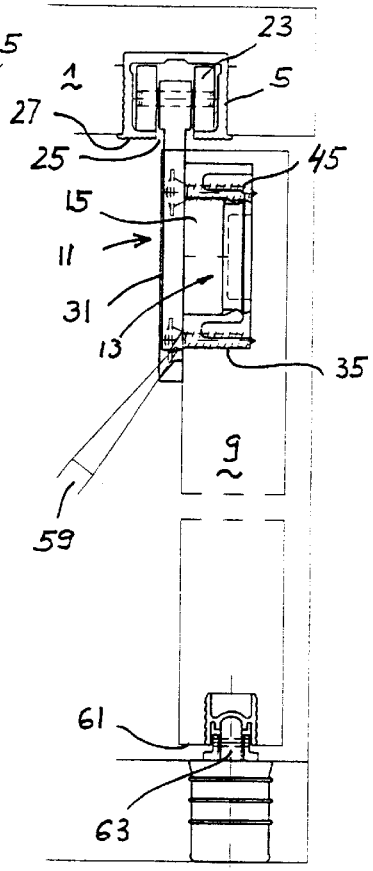
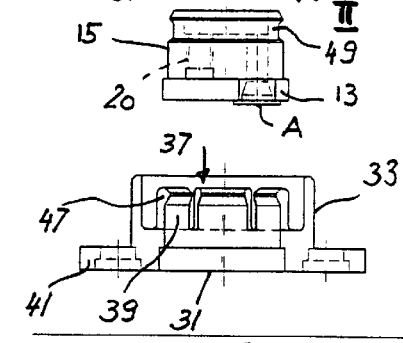
FIG. 3
FIG. 4
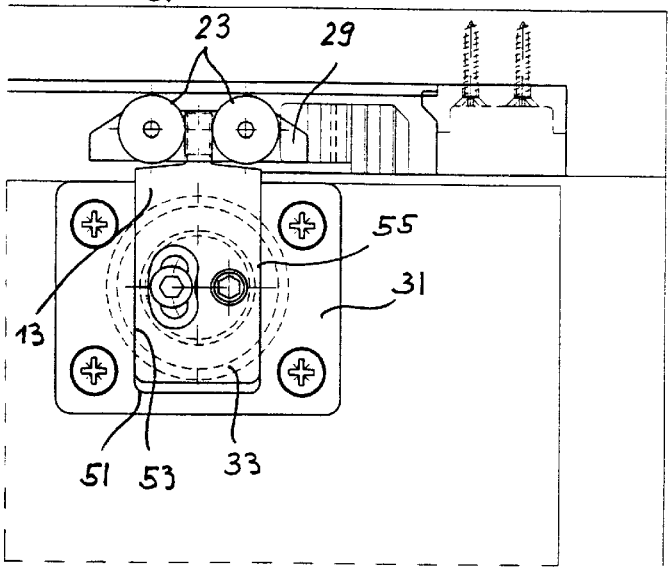
FIG. 5

RUNNING MECHANISM ASSEMBLY FOR A SLIDING DOOR

BACKGROUND OF THE INVENTION

The present invention relates to a running mechanism assembly for a sliding door including at least one running roller which is rotatably attached to a height-adjustable roller carrier, an eccentric disk rotatably arranged on the roller carrier with a wrench fixture for adjusting the eccentric disk, and a fastening plate having a cylindrical extension for insertion into a pot bore hole on the sliding door and a recess for the roller carrier.

Running mechanism assemblys for sliding doors are known in many designs. They serve to guide sliding doors hanging on rollers. In the process of minimizing costs and simplifying assembly, the running mechanisms must be subsequently connectable with the sliding door with little assembly expenditure. For this purpose, with most known constructions of running mechanisms, pot bore holes, i.e., cylindrical bore holes which do not completely penetrate the sliding door, are created in the sliding door. Into these bore holes, cylindrical extensions of the running mechanisms, which are already mounted in a carrier rail on the ceiling of the cabinet or closet, can then be inserted and fastened.

So that manufacturing inaccuracies on the sliding door and/or on the cabinet can be compensated for, qualitatively superior running mechanism assemblies require equipment by which any sliding door is adjustable as to height. For this purpose, an eccentric disk is provided, which is inserted into the running mechanism and which can be activated with a screw driver. Most designs have locking screws which, after adjustment, connect the carrier plate of the running mechanism immovably with the sliding door. Such devices fulfill their purpose, but a subsequent readjustment becomes troublesome. Moreover, after adjustment, the locking screw must be installed in an additional operation. For these reasons, it is often forgotten or deliberately omitted, and the sliding door will, after being used for a certain period, no longer hang exactly adjusted on the guide rail.

SUMMARY OF THE INVENTION

An object of the present invention is to create a running mechanism assembly with simple construction and with a locking device for height adjustment which requires no subsequent installation of a set screw, and which permits a subsequent adjustment at any time. This objective is accomplished by a running mechanism assembly in which the roller carrier with the eccentric disk fastened to it is firmly clampable and height-adjustable on the fastening plate.

The integration of the locking screw into the eccentric disk for height adjustment makes possible a compact construction and the use of the same screw driver, e.g., a socket head cap screw driver for height adjustment as well as for locking. By loosening the lock, a readjustment can take place at any time, for example when, owing to changes in humidity in the room, the sliding door or the cabinet expands or contracts. Since the adjustment screw is arranged in the eccentric, and the locking screw is arranged on the cabinet interior, servicing them is especially simple because it can take place with the same screw driver, and no additional bore holes for locking are necessary after mounting the sliding doors.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiment(s) which are presently preferred. It should be understood, however, that the invention is not limited to the precise assemblys and instrumentalities shown. In the drawings:

FIG. 1 is a rear view of a sliding door guided with a running mechanism in a cabinet (carrier rail shown in longitudinal section);

FIG. 2 is a cross section along line II—II through the sliding door (including its bottom guide);

FIG. 3 is a horizontal section through the eccentric disk along line III—III in FIG. 1;

FIG. 4 is a horizontal section through the fastening plate along line III—III in FIG. 1; and FIG. 5 is a view as in FIG. 1, but with a tandem roller running mechanism.

DETAILED DESCRIPTION OF THE INVENTION

On the ceiling 1 of a cabinet 3, a carrier rail 5 is fastened by means of screws 7 or by locking in a groove. A sliding door 9 is suspended by a running mechanism assembly 11 on the carrier rail 5.

The running mechanism assembly 11 includes a roller carrier 13 on which, mounted eccentrically on axis A, an eccentric disk 15 is pivoted. The rotation axis A is formed by a sleeve 17 with a hexagonal recess and penetrates the roller carrier 13. The hexagonal recess in sleeve 17 is accessible from the back side of the running mechanism.

A locking screw 19 which penetrates the roller carrier 13 is likewise accessible from the back side of the roller carrier 13. This penetrates the roller carrier 13 in a slot-like opening 21, which is constructed as a circular (arc-shaped) segment lying concentrically to axis A. The locking screw 19 is held guided axially adjustable in a threaded hole 20 in the eccentric disk 15 (see FIG. 3).

On the upper end of the roller carrier 13, on a horizontally lying rotation axis B, a pair of rollers 23 is rotatably mounted. The pair of rollers 23 rolls within the carrier rail 5 on two rolling surfaces 27 arranged laterally of a slot 25 in the carrier rail 5 (see FIG. 2).

In the embodiment acording to FIG. 5, a tandem pair of rollers, which is mounted on a balance, replaces a single pair of rollers 23, which guarantees an even support of both pairs of rollers 23 on the rolling surfaces 27. The remaining parts of the running roller assembly correspond to those in FIG. 1.

The eccentric disk 15 is rotatably mounted in a fastening plate 31. The latter includes a cylindrical extension 33 which is held substantially free of play in a pot bore hole 35 in the sliding door. In the interior of the cylindrical extension 33, a cage 37 is formed which has a radially elastic wall preferably consisting of a plurality of tongues 39 forming the cage 37. The roots of the tongues 39 are located on the base place 41 of the fastening plate 31. On the fastening plate a plurality of bore holes 43 is provided, which serve for passage of the fastening screws 45 (see FIG. 2) by which the fastening plate 31 is mounted on the sliding door 9. On the free ends of the tongues 39, radially inwardly directed thickenings or cams 47 are formed, which are designed to engage in a peripheral groove 49 on the eccentric disk 15, when this is axially inserted into the fastening plate 31. Following the axial insertion, the substantially rectangular roller carrier 13 lies in a vertically running recess 51 in the fastening plate 31 and is guided play-free with its lateral edges 53 along the lateral boundaries 55 of the recess 51 (see FIG. 5 for clarity).

The mode of functioning or the mounting of the running mechanism assembly is briefly explained below.

The roller carrier 13 is introduced into the carrier rail 5 during manufacture of the cabinet 3 and is thereby secured, i.e., the roller carrier can no longer exit from the carrier rail or through its underlying slot. The pot bore hole 35 is bored in the sliding door in a conventional manner, and after this the fastening plate 31 or, more specifically, its extension 33 is inserted into the pot bore hole 35, and the fastening plate is firmly connected with the sliding door by fastening screws 45. In the installation position of the cabinet, the sliding door 9 is brought into functioning position and the roller carrier 13 or, more specifically, the eccentric disk 15 fastened to it is inserted axially into the cage 37 until the peripheral groove 49 of the disk locks on the cams 47. Subsequently, the sliding door 9 is exactly aligned relative to the horizontal with a socket head cap screw wrench. With the same socket head cap screw wrench, the locking screw 19 can now be drawn firmly directly beside the sleeve 17, and the sliding door can thereby now be firmly set in relation to the cabinet 3.

If the sliding door 9 needs to be resuspended at a later point in time, the roller carrier 13 can be pried out of the cage 37 with a screw driver 59 (FIG. 2).

Preferably, identical wrench fixtures are formed on the eccentric disk 15 and on the locking screw 19, so that only one screw driver or wrench can be used for both activations.

For guiding the sliding door 9 in the region of its lower edge 61, a spring bolt 63 or some other guiding device known in the art can be used. This is not part of the present invention.

It will be appreciated by those skilled in the art that changes could be made to the embodiment(s) described above without departing from the broad inventive concept thereof. It is understood, therefore, that this invention is not limited to the particular embodiment(s) disclosed, but it is intended to cover modifications within the spirit and scope of the present invention as defined by the appended claims.

I claim:

1. A running mechanism assembly for a sliding door (9), comprising at least one running roller (23) rotatably fastened on a height-adjustable roller carrier (13), an eccentric disk (15) rotatably arranged on the roller carrier (13) with a wrench fixture for adjusting the eccentric disk (15), and a fastening plate (31) having a cylindrical extension (33) for insertion into a pot bore hole (35) on the sliding door (9), the fastening plate (31) having a recess (55) for the roller carrier (13), wherein the roller carrier (13) with the eccentric disk (15) fastened to it is firmly clamped and height-adjustable on the fastening plate (31).

2. The running mechanism assembly according to claim 1, wherein the wrench fixture comprises a sleeve (17), the sleeve (17) having a hexagonal recess formed therein for rotating the sleeve (17) and the eccentric disk (15).

3. The running mechanism assembly according to claim 1, wherein the cylindrical extension (33) of the roller carrier (13) comprises a cage (37) for accommodating the eccentric disk (15), the cage comprising a radially elastic wall.

4. The running mechanism assembly according to claim 3, wherein the wall comprises a plurality of tongues (39) mounted on the fastening plate (31).

5. The running mechanism assembly according to claim 4, wherein cams (47) are formed on free ends of the tongues (39).

6. The running mechanism assembly according to claim 5, wherein the eccentric disk (15) has a peripheral groove (49) for locking in the cams (47).

7. The running mechanism assembly according to claim 1, wherein a locking screw (19) which penetrates the roller carrier (13) is arranged in a threaded bore hole (20) in the eccentric disk (15), the locking screw (19) being screwable for locking the eccentric disk (15) relative to the roller carrier (13).

8. The running mechanism assembly according to claim 7, wherein the locking screw (19) penetrates an arc-shaped opening (21) in the roller carrier (13).

9. The running mechanism assembly according to claim 7, wherein identical wrench fixtures are formed on the eccentric disk (15) and on the locking screw (19) for activation thereof.

* * * * *